United States Patent [19]

Miyake et al.

[11] Patent Number: 4,613,229

[45] Date of Patent: Sep. 23, 1986

[54] CLEANING APPARATUS

[75] Inventors: Hiroyuki Miyake; Takaji Yonemori, both of Kawasaki, Japan

[73] Assignee: Canon Kabushiki Kaisha, Tokyo, Japan

[21] Appl. No.: 776,223

[22] Filed: Sep. 16, 1985

[30] Foreign Application Priority Data

Oct. 2, 1984 [JP] Japan ..... 59-206604

[51] Int. Cl.[4] ..... G03G 15/00

[52] U.S. Cl. ..... 355/15; 15/256.52

[58] Field of Search ..... 355/15; 118/652; 15/256.52; 101/425

[56] References Cited

U.S. PATENT DOCUMENTS

| | | | |
|---|---|---|---|
| 3,634,077 | 8/1968 | Sullivan | 96/1.4 |
| 3,656,200 | 4/1972 | Riley, Jr. | 15/97 |
| 3,838,472 | 10/1974 | Oriel | 15/256.51 |
| 3,955,533 | 5/1976 | Smith et al. | 118/652 |
| 4,252,435 | 2/1981 | Manghirmalani | 355/15 |

OTHER PUBLICATIONS

*IBM Technical Disclosure Bulletin*, vol. 16, No. 4, Sep. 1973, Davidge et al, "Force Loaded Cleaning Station", pp. 1265–1266.

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A cleaning apparatus for a copying machine employs a resilient cleaning roller 8 which presses against and forms a nip with the surface of a photosensitive member 1. The roller 8 has a hollow shaft 13 through which a driving shaft 14 is received. Driving force is transmitted to the resilient cleaning roller 8 at the end of the driving shaft 14 which is remote from the end thereof where a driving force is applied. In consequence, the nip between the photosensitive member 1 and the resilient cleaning roller 8 is favorably stabilized. It is therefore possible to minimize the risk of the photosensitive member 1 being damaged and to enhance the effect of the cleaning apparatus in removing charging products which cling to the surface of the photosensitive member. Further, it conveniently becomes unnecessary to effect any delicate adjustment of the position of the cleaning roller 8.

15 Claims, 10 Drawing Figures

CLEANING APPARATUS

BACKGROUND OF THE INVENTION

1. Field of the Invention

The present invention relates to a cleaning apparatus for a copying machine which employs a resilient roller. More particularly, tne invention pertains to a cleaning apparatus in which a resilient roller is rotated in such a manner as to be in resilient contact with the surface of a photosensitive member, thereby removing toner remaining on the surface of the photosensitive member, and also removing any charging product formed thereon as the result of charging, and any other foreign substances, such as dust, which may be attached to the photosensitive member surface.

2. Description of the Prior Art

U.S. Pat. Nos. 3,838,472, 3,634,077 and U.S. Pat. No. 3,656,200 all disclose electrophotographic copying machines having a cleaning roller apparatus to remove toner which remains on the surface of a photosensitive member after an image transfer operation. However, the cleaning roller driving mechanism of the present invention is not disclosed in the known prior art.

Referring now to FIG. 1, there is shown schematically a cross-section view of a conventional cleaning apparatus which employs a resilient roller and which is applied to an electrophotographic copying machine. The copying machine operates as follows: The surface of a cylindrical photosensitive member 1, which is rotated in the direction of the arrow A in FIG. 1, is first uniformly charged by an electrostatic charger 2 which is disposed at the periphery of the photosensitive member 1. Then, a light image 7 is projected onto the charged surface of the photosensitive member 1, whereby an electrostatic latent image, which corresponds to the light image 7, is formed on the surface of the photosensitive member 1. As the photosensitive member 1 continues to rotate, the latent image passes by a developer 3 where it is transformed into a visible image of toner. This toner image is the transferred to a transfer medium, such as paper 4, which is fed to a transfer section having a transfer electrode 5. The transfer medium is then conveyed to a fixing section (not shown). During the above-described operation, any toner which has not become transferred to the paper 4 or other transfer medium at the transfer section consequently remains on the surface of the photosensitive member 1, together with other foreign substances. This remaining toner and the other foreign substances are then carried by the photosensitive member 1 past a cleaning apparatus 6 where they are removed from the surface of the photosensitive member. Thus, before reaching the charging section, the surface of the photosensitive member 1 is restored to a state wherein a subsequent copying operation can be effected.

The cleaning apparatus 6 in the copying machine of the type described above generally employs a resilient roller 8 which is disposed inside the cleaning apparatus 6. The arrangement of the cleaning apparatus 6 will now be described in more detail with reference to the enlarged fragmentary cross section view of FIG. 2.

As will be clear from FIG. 2, the cleaning apparatus 6 includes an elongated casing **6*b* which extends parallel to and in close proximity with the photosensitive member 1. A cleaning blade 6*a* is mounted on an upper part of the casing 6*b*. The cleaning blade 6*a* has one edge thereof brought into resilient contact with the surface of the photosensitive member 1 so as to scrape away, in well known manner, any remaining toner which clings to the surface of the photosensitive member 1** and is conveyed together therewith.

A resilient cleaning roller 8 is disposed in the casing **6*b*, on the upstream side of the cleaning blade 6*a* (in terms of the direction of rotation of the photosensitive member 1, which turns in the direction of the arrow A in FIG. 2). The cleaning roller 8 comprises an inner layer 8*b* of relatively low hardness silicone sponge material and an outer layer 8*a* of a relatively high hardness stable silicone rubber. The outer layer 8*a* of the cleaning roller 8 is maintained in resilient contact with the surface of the photosensitive member 1. The cleaning roller 8 rotates in the direction of the arrow B at a relative velocity with respect to the surface of the photosensitive member 1 and brushes against the surface of the photosensitive member in such a manner as to remove the remaining toner, paper dust, corona product, and so forth, from the surface of the photosensitive member 1**.

The remaining toner and other substances which have thus been removed from the photosensitive member 1 by the cleaning roller 8 and which have been scraped off from the photosensitive member 1 by the cleaning blade **6*a*, are carried around with rotation of the cleaning roller 8 and are scraped off from the surface of the roller 8 by means of a scraper 10. Such toner and other substances are thereby deposited in a storage portion of the casing 6*b* before being discharged to the outside of the casing 6*b* by means of a screw conveyor 9**.

In the above described cleaning apparatus 6, the resilient contact pressure applied to the surface of the photosensitive member 1 by the resilient cleaning roller 8 is calculated in terms of the nip therebetween. An excessively large nip pressure undesirably makes it easy for the surface of the photosensitive member 1 to become cracked or flawed. On the other hand, an excessively small nip pressure unfavorably reduces the effectiveness of the cleaning roller 8 in removing charging products from the surface of the photosensitive member. Accordingly, it has heretofore been necessary to finely adjust both the width and the balance of the nip in the longitudinal direction of the photosensitive member 1 and the cleaning roller 8 during the rotation of both members. Moreover, as the roller 8 becomes worn, it is necessary as a matter of course to effect an additional fine adjustment by an amount corresponding to the degree of wear. These adjustments have previously been carried out by moving the position of the cleaning roller 8 with respect to the photosensitive member 1 while measuring the distance between their respective centers. Accordingly, in this method, the nip adjustment is effected by properly adjusting the distance between the respective centers of the photosensitive member 1 and the cleaning roller 8; and in such case the nip width undergoes a large change with respect to any given change in the distance between the respective centers of the photosensitive member 1 and the cleaning roller 8. This situation requires a very delicate adjustment (e.g., the nip width changes by 0.5 to 1 millimeters (mm) when the distance between centers is changed by 60 microns ($\mu$)). Variations in the nip width involve adverse effects as described above. That is, an excessively small nip width reduces the effectiveness of the cleaning roller 8 in removing charging products, which is a primary object of the provision of the cleaning roller 8; while an excessively large nip width causes the photosensitive member 1 to be easily cracked.

One conventional method of adjusting the nip width, as illustrated in FIG. 3, involves pressing the cleaning roller against the surface of the photosensitive member 1 by means of springs 20. With this method, however, the balance between the two ends of the cleaning roller 8 is easily destroyed due to the pressing force applied to the cleaning roller 8 by the driving gear which rotates the cleaning roller. Should there be any imbalance in the pressing force at the two ends of the cleaning roller 8, such condition will produce a variation in the nip along the surface of the photosensitive member 1 in its longitudinal direction.

SUMMARY OF THE INVENTION

The present invention overcomes the above described problems of the prior art. In its broader aspect the invention provides novel apparatus for cleaning the surface of an image carrying member. This novel apparatus includes a cleaning roller having a resilient layer and a mounting means for holding the cleaning roller and causing it to press the resiliently against the surface of an image carrying member. There is also provided a cleaning roller drive shaft, a fixed bearing rotatably supporting the drive shaft at a first location therealong, a rotatable drive element for rotatably driving said drive shaft at a second location therealong and producing a lateral force on the drive shaft, and a connecting arrangement between the drive shaft and the cleaning roller for transmitting rotation of the drive shaft to the cleaning roller and for transmitting the lateral force of the drive shaft from a third location therealong to the cleaning roller. The distance along the drive shaft between the first and third locations is substantially greater than the distance along the drive shaft between the first and second locations. In this way the lateral forces on the cleaning roller, which result from driving the drive shaft, are greatly reduced.

According to one feature of the invention there is provided a cleaning apparatus for a copying machine, which cleaning apparatus is capable of minimizing any imbalanced condition of the cleaning roller as between its two ends.

In a preferred arrangement, the cleaning apparatus of the present invention is characterized by a resilient cleaning roller having a hollow shaft through which a driving shaft is received; and driving force is transmitted to the cleaning roller from the driving shaft at the end thereof which is remote from the location thereon where driving forces are applied to the driving shaft.

By virtue of the above-described arrangement, the nip of the photosensitive member and the cleaning roller is favorably stabilized. It is therefore possible to minimize the risk of the photosensitive member being damaged and to enhance the effect of the cleaning apparatus in removing charging products attached to the surface of the photosensitive member. Further, it conveniently becomes unnecessary to effect any delicate adjustment of the position of the cleaning roller.

The above and other objects, features and advantages of the invention will become clear from the following description of the preferred embodiments thereof, taken in conjunction with the accompanying drawings:

DESCRIPTION OF THE PREFERRED EMBODIMENTS

Figure 1:
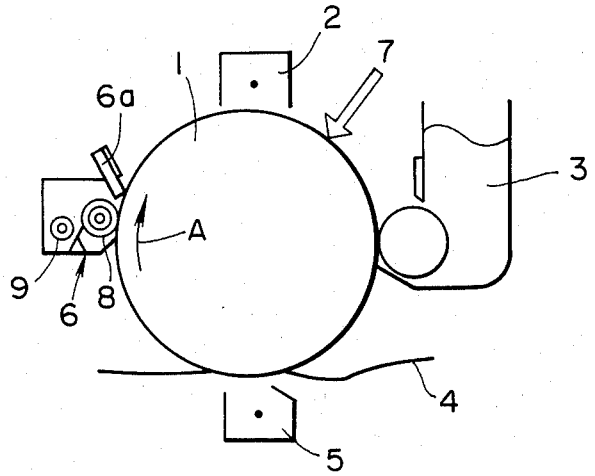
FIG. 1 (PRIOR ART)
FIG. 1 is diagrammatic cross-sectional view of an electrophotographic copying machine showing a prior art cleaning apparatus employing a resilient roller.
Figure 2:
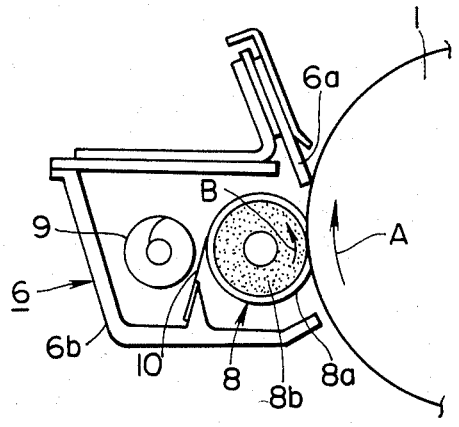
FIG. 2 (PRIOR ART)
FIG. 2 is an enlarged fragmentary view of the cleaning apparatus of the copying machine shown in FIG. 1.
Figure 3:
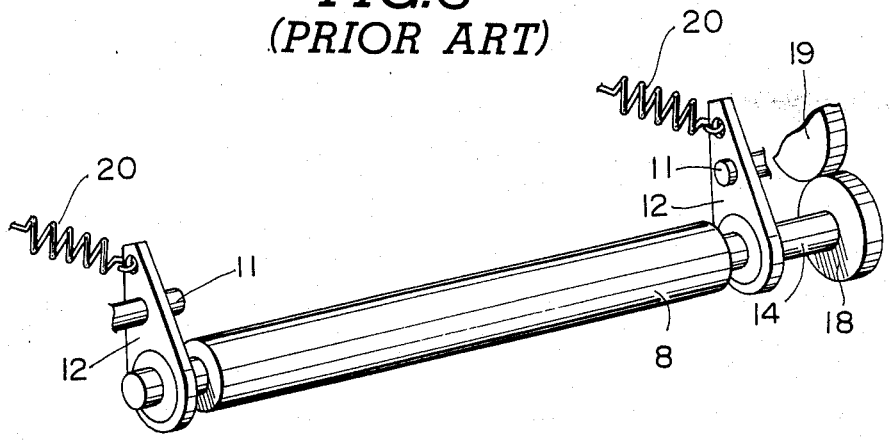
FIG. 3 (PRIOR ART)
FIG. 3 is a perspective view of a mounting and biasing mechanism for the cleaning apparatus of FIG. 2.
Figure 4:
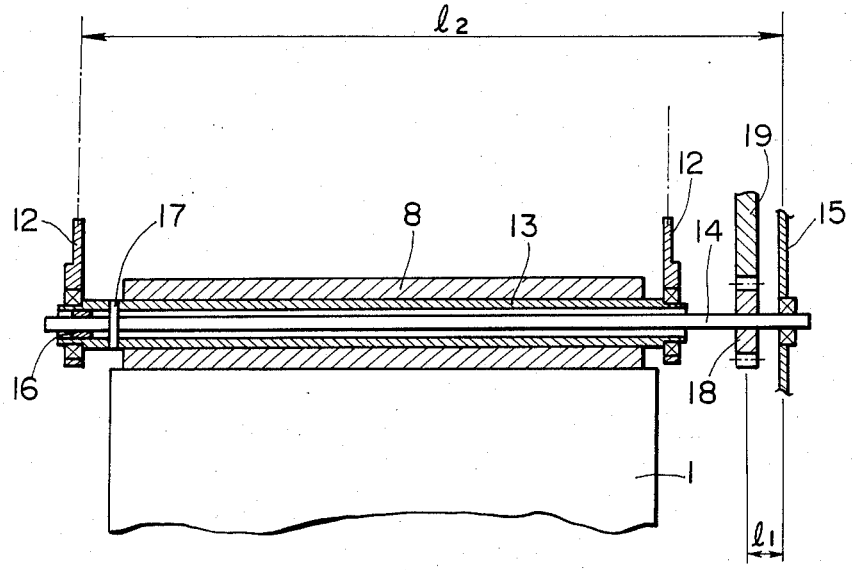
FIG. 4 is a diagrammatic longitudinal sectional view of a cleaning apparatus according to the present invention.
Figure 5:
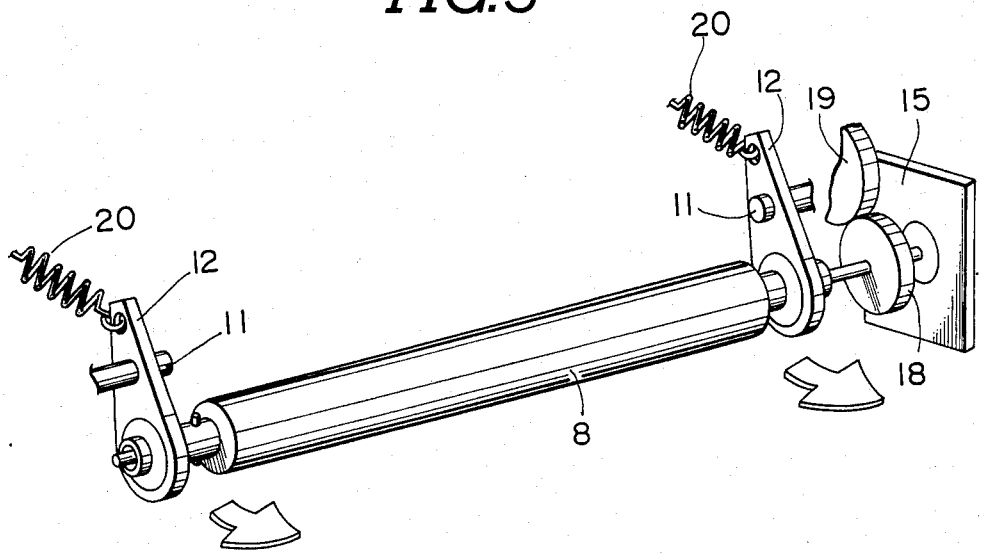
FIG. 5 is a perspective view of a mounting and biasing mechanism for the cleaning apparatus shown in FIG. 4.

As shown in FIGS. 4 and 5, a cleaning roller 8 is rotatably mounted, by means of associated bearings, in arms 12. The arms 12 in turn are pivotally supported by respective pivots 11 which are fixed in an electrophotographic apparatus in which the cleaning device of this invention is used. Rotational driving force is transmitted to the cleaning roller 8 in the following manner. As shown in FIG. 4, the roller 8 has a hollow shaft 13; and a driving shaft 14 extends through an axial passage inside of the shaft 13. A first location along the driving shaft 14, i.e. at or near its right end (as viewed in FIG. 4), is rotatably mounted in a bearing which is supported by a plate 15. The plate 15 itself is fixed in the electrophotographic apparatus. The left end of the driving shaft 14 is connected to the surface of the axial passage at the left end of the hollow shaft 13 by means of a connecting arrangement which includes a resilient pad 16. The pad 16 maintains the axis of the driving shaft 14 aligned with the axis of the hollow cleaning roller shaft 13. Further, a pin 17 is secured to the driving shaft 14 and engages the surface of the axial passage at the of the end of the hollow cleaning roller shaft 13. This engagement is obtained by means of a U-groove or slot which is formed in the shaft 13. The pin 17 is engaged in this U-groove. Thus, tne driving force of the driving shaft 14 is transmitted to the cleaning roller 8 through the engagement between the pin 17 and the U-groove.

Figure 6:
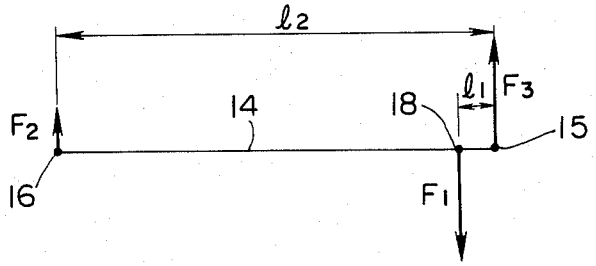
FIG. 6 is a force diagram which illustrates the relationship of the forces acting on a cleaning roller driving shaft in the apparatus of FIG. 4.
Figure 7:
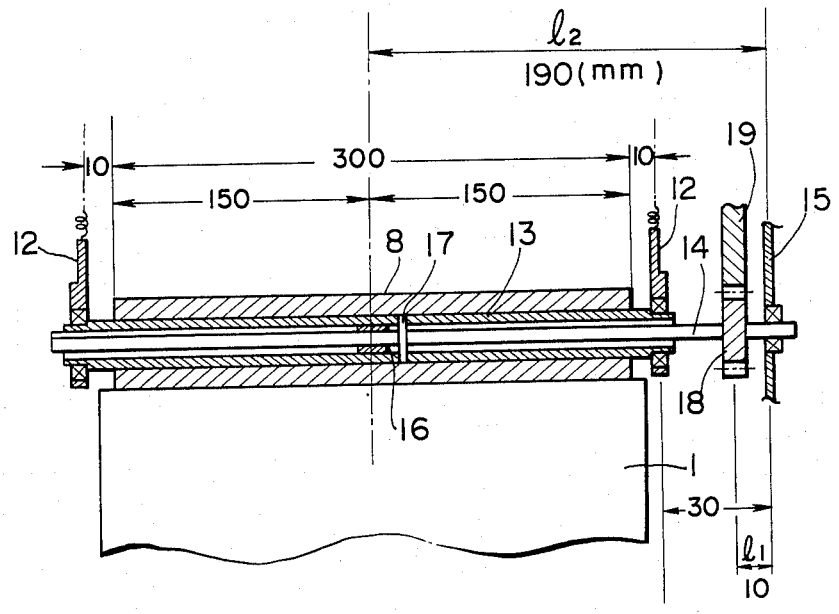
FIG. 7 is a view similar to FIG. 4 but showing the connection between the cleaning roller and the driving shaft at a different location along the driving shaft.

The driving shaft 14 is rotated by a driving force which is transmitted to a gear 18. The gear 18 is secured to the driving shaft 14 at a second location therealong. The gear 18 is driven by a gear 19 which serves as a driving source with respect to the gear 18. When the gear 18 is driven by the gear 19, a force acts as a matter of course in the direction of the angle at which pressure from the gear 19 is applied to the gear 18. However, since the gear 18 is rotatably retained by the fixed plate 15 through the driving shaft 14, no large force acts on the driving shaft 14 in the direction in which the arm 12 at the right end of the shaft 14 would otherwise be pivoted about the pivot 11. More specifically, when for example, a force of 250 grams (g) is applied to a spring 20 and a force of 200 g is applied to the portion of the driving shaft 14 where the gear 18 is secured (i.e. the second location), since one end of the driving shaft 14 is rotatably secured (i.e. at the first location), the pressing force acts on the resilient pad 16 (i.e. at a third location along the driving shaft 14) in the proportion of $F_1 \times l_1 = F_2 \times l_2$ as shown in FIG. 6. Here $F_1$ represents the lateral force imposed on the driving shaft 14 by the gear 18 at the second location; $F_2$ represents the lateral force imposed on the driving shaft 14 by the resilient pad 16 at the third location; and $F_3$ represents the reaction force imposed on the shaft 14 by the bearing in the plate 15. Further, $l_1$ represents the distance along the driving shaft 14 between the first and second locations and $l_2$ represents the distance along the driving shaft 14 between the first and third locations. Thus, the pressing force which actually acts on the resilient pad 16 is given by $F_2 = l_1/l_2 \times F_1$. Assuming now that $l_1 = 10$ millimeters (mm). In such case the pressing force $F_2$ is calculated as follows: $F_2 = 10$ mm/350 mm$\times$200 g$=5.7$ g. Hence, the above-described balancing relationship in terms of the force applied to both ends of the cleaning roller 8 is expressed by $500/(500+5.7) \div 1/1.01$, taking biasing forces of both the springs 20 into consideration. Thus, any imbalance in force between the two ends of the roller 8 which may be caused by the driving force is reduced to about 1%. This may be practically ignored in contrast to the imbalance which may be caused by variations in the biasing force of the springs 20 themselves. As a result, the nip of the photosensitive member 1 and the roller 2 is favorably stabilized. There is therefore no fear of the photosensitive member 1 being damaged by the nip pressure, and the effect of the cleaning is thereby enhanced. Further, it becomes unnecessary to effect any delicate adjustment of the position of the roller 8. FIG. 7 illustrates a modification wherein the connection between the driving shaft 14 and the hollow shaft 13 of the cleaning roller 8, i.e., the resilient pad 16 and pin 17, is shifted to the center of the cleaning roller. As can be seen from the preceeding description, the benefits of the invention are achieved when the ratio $l_2/l_1$ is high. Now, in the case of FIG. 7, where the resilient pad 16 is located at the center of the cleaning roller 8, it will be assumed that the distance $l_2$ between the resilient pad 16 (i.e. the third location) and the mounting at the wall 15 (i.e. the first location) along driving shaft 14 is 190 mm, and the distance $l_1$ between the gear 18 (i.e. the second location) and the mounting at the wall 15 (i.e. the first location) along the driving shaft 14 is 10 mm. In such case $F_2 = l_1/l_2 \times F_1$. Thus, $F_2 = 10$ mm/190 mm$\times$200 g, i.e. $F_2 = 10.5$ g. The springs 20 produce a combined biasing force of about 500 g with a variation of plus or minus 3%, or 15 g. Thus the force $F_2$ of 10.5 g is within the range of accuracy of each spring and therefore the cleaning roller 8 is not subject to appreciable influence from lateral forces imposed by the driving shaft 14. Thus even when the connection provided by the resilient pad 16 is shifted to the center of the cleaning roller 8, the roller is not subjected to any appreciable lateral force. It will also be appreciated that when the connection provided by the resilient pad 16 is in the center of the cleaning roller 8, the minimal lateral force imposed on the cleaning roller is balanced between its two ends so that there is no tendency for one end of the roller to press harder against the photosensitive member 1 than the other end.

By way of comparison, if the connection provided by the resilient pad 16 were shifted to the right end of the cleaning roller 8 so that the distance $l_2$ became 30 mm, then the value of $F_2$ would be 10 mm/30 mm$\times$200 g, or 66.7 g; and, in such case, the force $F_2$ would have a substantial influence on the pressure of the cleaning roller 8 against the photosensitive surface 1. Thus the connection between the driving shaft and the cleaning roller 8 (i.e. the third location) should be at least far enough from the mounting at the wall 15 (i.e. the first location) so that there is produced a lateral force which is less than the variation in biasing force of the springs 20.

Figure 8:
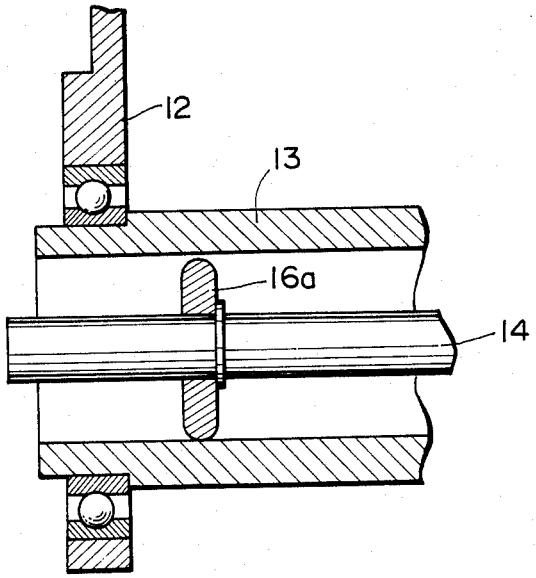
FIG. 8 is an enlarged fragmentary section view showing a modified interconnection between the cleaning roller and the driving shaft.

The resilient pad 16, the above described construction, is preferably made of urethane rubber, nitrilbutadiene or chloroprene rubber. FIG. 8 shows a first modification of the connection between the driving shaft 14 and the hollow shaft 13 of the cleaning roller 8. In FIG. 8 there is shown a pad **16*a* of rigid material, such as metal. Because the lateral forces on the driving shaft 14 cause a finite, though small, deflection, and in order to compensate for dimensional errors in the shafts 13 and 14, the diameter of the rigid pad 16*a* is made slightly smaller in diameter than the inside diameter of the hollow shaft 13 of the cleaning roller 8**.

Figure 9:
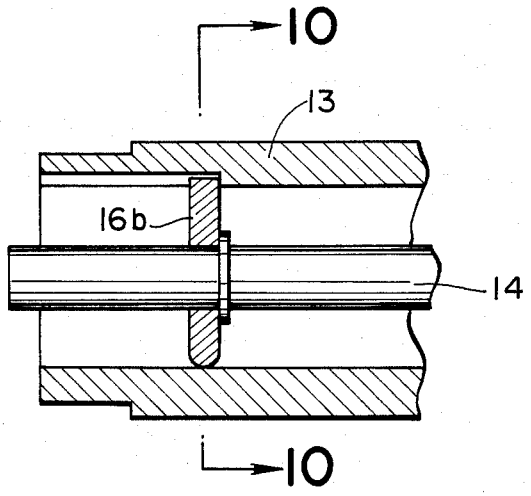
FIG. 9 is a view similar to FIG. 8 but showing a further modification of the interconnection between the cleaning roller and the driving shaft.
Figure 10:
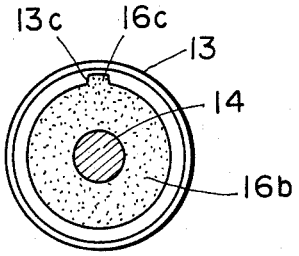
FIG. 10 is a cross-sectional view taken along line 10-10 of FIG. 9.

FIGS. 9 and 10 show a further modification of the connection between the driving shaft 14 and the hollow shaft 13 of the cleaning roller 8. As shown in FIGS. 9 and 10, there is provided a pad **16*b* which is formed with a projection 16*c* which fits into a channel 13 formed to extend longitudinally in the hollow shaft 13 of the cleaning roller 8. The projection and channel provide a rotational drive connection between the shafts 14 and 13; and because of this the pin 17** of the preceeding embodiments may be eliminated.

It will be appreciated from the foregoing that the present invention effectively minimizes lateral forces on the cleaning roller 8 so that the pressure of the cleaning roller on a photosensitive surface can be maintained.

Although the invention has been described in specific terms, it is to be understood that the described embodiments are only illustrative and various changes and modifications may be made without departing from the spirit and scope of the invention which is limited solely by the appended claims.

We claim:

1. Apparatus for cleaning the surface of an image carrying member, said apparatus comprising, a cleaning roller having a resilient layer, mounting means for holding said cleaning roller and causing it to press resiliently against the surface of an image carrying member, a cleaning roller drive shaft, a fixed bearing rotatably supporting said drive shaft at a first location therealong, a rotatable drive element rotatably driving said drive shaft at a second location therealong and producing a lateral force on said drive shaft, and a connecting arrangement between said drive shaft and said cleaning roller for transmitting rotation of said drive shaft to said cleaning roller and for transmitting the lateral force of said drive shaft from a third location therealong to said cleaning roller, the distance along said drive shaft between said first and third locations being substantially greater than the distance along said drive shaft between said first and second locations.

2. Apparatus according to claim 1 wherein said connecting arrangement includes a resilient pad interconnecting said drive shaft and said cleaning roller at said third location.

3. Apparatus according to claim 1 wherein said connecting arrangement is constructed to transmit rotation of said drive shaft to said cleaning roller from a location on said drive shaft near said third location.

4. Apparatus according to claim 2 wherein said resilient pad is arranged to transmit rotation of said drive shaft to said cleaning roller and to transmit the lateral force in said drive shaft from said third location to said cleaning roller.

5. Apparatus according to claim 1 wherein said fixed bearing and said drive element are near one end of said cleaning roller and wherein said connecting arrangement is near the opposite end of said cleaning roller.

6. Apparatus according to claim 1 wherein said second location along said drive shaft is between said first location and said third location.

7. Apparatus according to claim 1 wherein said cleaning roller is formed with an axial passage and wherein said drive shaft extends through said axial passage.

8. Apparatus according to claim 7 wherein said connecting arrangement includes a resilient pad extending between said drive shaft at said third location and the surface of said axial passage for transmitting the lateral force in said drive shaft to said cleaning roller.

9. Apparatus according to claim 8 wherein said connecting arrangement further includes a pin extending from said drive shaft to the surface of said axial passage for transmitting rotation of said drive shaft to said cleaning roller.

10. Apparatus according to claim 7 wherein said connecting arrangement includes a rigid element extending from said drive shaft at said third location toward the surface of axial passage said rigid element being in said axial passage said loosely fitted in said axial passage.

11. Apparatus according to claim 10 wherein said rigid element and the surface of the axial passage are formed, one with a groove and the other with a projection which fits into the groove, to transmit rotation of said drive shaft to said cleaning roller.

12. Apparatus according to claim 7 wherein said fixed bearing and said drive element are positioned at one end of said cleaning roller and wherein said connecting arrangement is located inside said axial passage.

13. Apparatus according to claim 12 wherein said connecting arrangement is located closer to the other end of said cleaning roller than to its said one end.

14. Apparatus according to claim 1 wherein said distance between said first and third locations is greater than the distance between said first and second locations by an amount such that the lateral force applied to said cleaning roller at said third location is less than the amount of variation in resilient bias provided by said mounting means.

15. Apparatus according to claim 1 wherein said third location is near the center of said cleaning roller.

* * * * *

UNITED STATES PATENT AND TRADEMARK OFFICE

CERTIFICATE OF CORRECTION

PATENT NO. : 4,613,229

DATED : September 23, 1986

INVENTOR(S) : Hiroyuki Miyake and Takaji Yonemori

It is certified that error appears in the above-identified patent and that said Letters Patent is hereby corrected as shown below:

Title page, OTHER PUBLICATIONS, change "pp. 1265-1266" to -- pp. 1265-1267 --.

Column 1, line 8, change "tne" to -- the --;

line 41, after "toner image is" change "the" to -- then --.

Column 3, line 25, delete "the".

Column 4, line 53, delete "of the";

line 57, change "tne" to -- the --.

Column 5, line 41, after "roller 8." start new paragraph at -- Fig. 7 --.

Column 6, line 38, change "preceeding" to -- preceding --.

UNITED STATES PATENT AND TRADEMARK OFFICE

CERTIFICATE OF CORRECTION

PATENT NO. : 4,613,229

DATED : September 23, 1986

INVENTOR(S) : Hiroyuki Miyake and Takaji Yonemori

It is certified that error appears in the above-identified patent and that said Letters Patent is hereby corrected as shown below:

Column 8, line 7, after "of" insert -- said --;
line 7, after "passage" insert a comma -- , --;
line 8, change "said" (second occurrence) to -- and --.

Signed and Sealed this

Third Day of March, 1987

*Attest:*

DONALD J. QUIGG

*Attesting Officer*

*Commissioner of Patents and Trademarks*